US009162449B2

(12) United States Patent
Byun et al.

(10) Patent No.: US 9,162,449 B2
(45) Date of Patent: Oct. 20, 2015

(54) APPARATUS FOR SPRAYING AND PATTERNING USING ELECTROSTATIC FORCE

(71) Applicant: Enjet Co. Ltd., Suwon-si, Gyeonggi-do (KR)

(72) Inventors: Do-Young Byun, Seoul (KR); Vu Dat Nguyen, Suwon-si (KR); Baek Hoon Seong, Pohang-si (KR)

(73) Assignee: Enjet Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/468,405

(22) Filed: Aug. 26, 2014

(65) Prior Publication Data

US 2015/0062250 A1 Mar. 5, 2015

(30) Foreign Application Priority Data

Aug. 27, 2013 (KR) ..... 10-2013-0101836

(51) Int. Cl.

| | |
|---|---|
| ***B41J 2/02*** | (2006.01) |
| ***B41J 2/06*** | (2006.01) |
| ***B05B 5/00*** | (2006.01) |
| *B41J 2/04* | (2006.01) |

(52) U.S. Cl.

CPC ... *B41J 2/06* (2013.01); *B05B 5/00* (2013.01); *B41J 2002/043* (2013.01)

(58) Field of Classification Search

CPC ..... B41J 2/06; B41J 2002/043; B05B 5/00
USPC ..... 347/73–83, 89–91
See application file for complete search history.

(56) References Cited

U.S. PATENT DOCUMENTS

| | | | | |
|---|---|---|---|---|
| 4,207,582 | A * | 6/1980 | Yamamoto | 347/74 |
| 8,465,810 | B2 * | 6/2013 | Umino | 427/475 |
| 8,705,114 | B2 | 4/2014 | Byun et al. | |
| 8,888,249 | B2 | 11/2014 | Byun et al. | |

OTHER PUBLICATIONS

Abstract of Korean Patent Publication—KR20100119234, Nov. 9, 2010, 1 page.

* cited by examiner

*Primary Examiner* — Henok Legesse
(74) *Attorney, Agent, or Firm* — Dority & Manning, P.A.

(57) ABSTRACT

There is disclosed an apparatus for spraying and patterning, using an electrostatic force, includes a nozzle to which a voltage is applied to exhaust ink, a droplet circulation chamber provided in one end of the nozzle, with a hole provided in one end to spray the ink exhausted from the nozzle based on a particle size of the droplet and to temporarily collect the not-sprayed ink, and a substrate for impacting the ink sprayed from the hole thereon by forming an electric field between the nozzle and the substrate.

8 Claims, 11 Drawing Sheets

APPARATUS FOR SPRAYING AND PATTERNING USING ELECTROSTATIC FORCE

CROSS REFERENCE TO RELATED APPLICATION

This application claims the benefit of the Patent Korean Application No. 10-2013-0101836, filed on Aug. 27, 2013, which is hereby incorporated by reference as if fully set forth herein.

BACKGROUND OF THE DISCLOSURE

1. Field of the Disclosure

The present invention relates to an apparatus for spraying and patterning, using an electrostatic force, more particularly, to an apparatus for spraying and patterning, using an electrostatic force, which may form an electric field from a nozzle to a substrate, using a voltage difference, and perform a primary atomization for liquid via the nozzle and a secondary atomization via an electric field, so as to spray droplets having a preset size enough to move along the electric field out of atomized spraying droplets via a hole to be carbonized to the substrate and to collect droplets having a larger size in a droplet circulation chamber, and which may use an electrostatic force adjusting a carbonization region accurately, using a mask or an electrostatic focusing unit.

2. Discussion of the Related Art

Generally, an electro hydrodynamic spraying apparatus includes a nozzle, a substrate or an electrode. Such an electro hydrodynamic spraying apparatus sprays ink, using an electrostatic force generated by a potential difference caused by a voltage applied between the nozzle and the substrate.

The electro hydrodynamic spraying sprays droplets or serial jets, using a force pulling a liquid level. Different from a conventional ink jet, the electro hydrodynamic spraying is able to perform nano-scale patterning and to discharge high-viscosity ink. Also, it is able to generate uniform droplets and discharge a micro-amount of ink. Accordingly, a lot of researches and studies are under progress about patterning in recent.

Meanwhile, conventional electro hydrodynamic spraying is called "electrospray". The electrospray has a small amount of liquid exhausted from a nozzle or capillary tube and it has a limited electric conductivity and a limited surface tension which are required to keep stable spraying.

Moreover, the sprayed droplets may be patterned, using connection to the electric field caused by the mask and the charge density of the droplets generated in the electrospray is so large to require an auxiliary charge control module disadvantageously.

SUMMARY OF THE DISCLOSURE

Accordingly, embodiments of the present disclosure provide an apparatus for spraying and patterning, using an electrostatic force, more particularly, to an apparatus for spraying and patterning, using an electrostatic force, which may form an electric field from a nozzle to a substrate, using a voltage difference, and perform a primary atomization for liquid via the nozzle and a secondary atomization via an electric field, so as to spray droplets having a preset size enough to move along the electric field out of atomized spraying droplets via a hole to be carbonized to the substrate and to collect droplets having a larger size in a droplet circulation chamber, and which may use an electrostatic force adjusting a carbonization region accurately, using a mask or an electrostatic focusing unit.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings. To achieve these objects and other advantages and in accordance with the purpose of the invention, as embodied and broadly described herein, an apparatus for spraying and patterning, using an electrostatic force, includes a nozzle to which a voltage is applied to exhaust ink; a droplet circulation chamber provided in one end of the nozzle, with a hole provided in one end to spray the ink exhausted from the nozzle based on a particle size of the droplet and to temporarily collect the not-sprayed ink; and a substrate for impacting the ink sprayed from the hole thereon by forming an electric field between the nozzle and the substrate.

The apparatus for spraying and patterning, using the electrostatic force, may further include a mask arranged between the droplet circulation chamber and the substrate, with a penetrated portion for adjusting a region where the ink is impacted, the mask to which a voltage is applied to focus an electric field in the penetrated portion.

The apparatus for spraying and patterning, using the electrostatic force, may further include an electric field focusing unit having one end connected to the hole and the other end connected to the mask, the electric field focusing unit to which a voltage is applied to focus the electric field in the penetrated portion.

The nozzle may include a liquid nozzle for exhausting the ink; a gas nozzle for primarily atomizing the ink by colliding the gas with the ink on an outlet passage of the ink; and a voltage applying unit connected to the liquid nozzle to generate an electric field between the liquid nozzle and the substrate so as to secondarily atomize the liquid.

The apparatus for spraying and patterning, using the electrostatic force, may further include a case for holding the liquid nozzle and the gas nozzle therein, with a gas passage to guide the gas sprayed from the gas nozzle to collide with the liquid on the outlet passage of the liquid, wherein the gas is collided with the liquid in the case.

The apparatus for spraying and patterning, using the electrostatic force, may further include a counter electrode provided in a counter surface of a surface where the ink is impacted, having a voltage applied thereto, wherein the substrate is formed of an electric insulative material.

The apparatus for spraying and patterning, using the electrostatic force, may further include an ink supply unit for holding the ink, with being connected to the nozzle to supply the ink; and a circulation pipe having one end connected to the droplet circulation chamber and the other end connected to the ink supply unit, to circulate the ink held in the droplet circulation chamber to the ink supply unit.

A voltage smaller than a voltage applied to the nozzle and larger than a voltage applied to the substrate may be applied to the mask, to spray the ink to the penetrated portion.

The nozzle may be arranged for a longitudinal direction of the liquid nozzle to be in parallel to the substrate, and the hole may be formed in an end portion of the droplet circulation chamber, with a predetermined portion of which a cross section area is reduced gradually toward the hole.

The nozzle may be arranged for a longitudinal direction of the liquid nozzle to be perpendicular to the substrate, and the hole may be formed in a lower end portion of the droplet circulation chamber and the lower end portion may be curved from a lower direction to an upper direction to form a space where the not sprayed ink is temporarily collected.

The apparatus for spraying and patterning, using the electrostatic force, may further include a sealing member for sealing the nozzle and the droplet circulation chamber to prevent the ink from leaking from the droplet circulation chamber.

According to the embodiments of the present disclosure, the fine particle types of the ink may be sprayed to the substrate from the nozzle by the droplet circulation chamber.

Furthermore, the ink not sprayed from the droplet circulation chamber may be circulated to the ink supply unit and re-sprayed to the substrate through the nozzle.

Still further, the mask to which the voltage is applied may be provided and the electric field can be focused in the penetrated portion. Accordingly, the ink may be impacted on the substrate more precisely and elaborate patterning may be performed.

Still further, the electric field focusing unit is provided and the electric field may be focused from the hole to the substrate. Accordingly, more elaborate patterning may be performed.

Still further, the plurality of the penetrated portions may be formed in the mask and the penetrated portions have a specific shape. accordingly, specific shapes may be patterned on a large area substrate simultaneously.

Still further, the nozzle includes the liquid nozzle and the gas nozzle, to atomize the ink primarily and to atomize the ink secondarily, using the electric field. Accordingly, the ink may be sprayed in droplet types with a size of a nanometer to 10 micrometers or less size more smoothly.

Still further, the droplet circulation chamber is installed to hold the end of the nozzle. Accordingly, the disadvantage of the droplet scattering caused by sudden dispersion of gas outside the nozzle can be solved.

Still further, the counter electrode is installed in the substrate. Although the substrate is formed of the non-conductive material, the electric field may be formed between the substrate and the nozzle and the ink can be impacted on the substrate.

Still further, the not sprayed droplets with the relatively large size may be circulated to the ink supply unit from the droplet circulation chamber. Accordingly, the ink may be sprayed in a gas type more smoothly.

Still further, the voltage applied to the mask or electric field focusing unit is smaller than the voltage applied to the nozzle and larger than the voltage applied to the substrate. Accordingly, the electric field for impacting the ink on the substrate may be formed.

Still further, the sealing member for sealing the nozzle to the droplet circulation chamber is provided. Accordingly, the fine particle types of the ink may be prevented from leaking from the droplet circulation chamber more smoothly.

It is to be understood that both the foregoing general description and the following detailed description of the embodiments are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts. Before describing embodiments, it is exemplified that a continuously variable speed gear set according to embodiments is applied to an electric vehicle and the embodiments herewith are not limited thereto.

Figure 1:
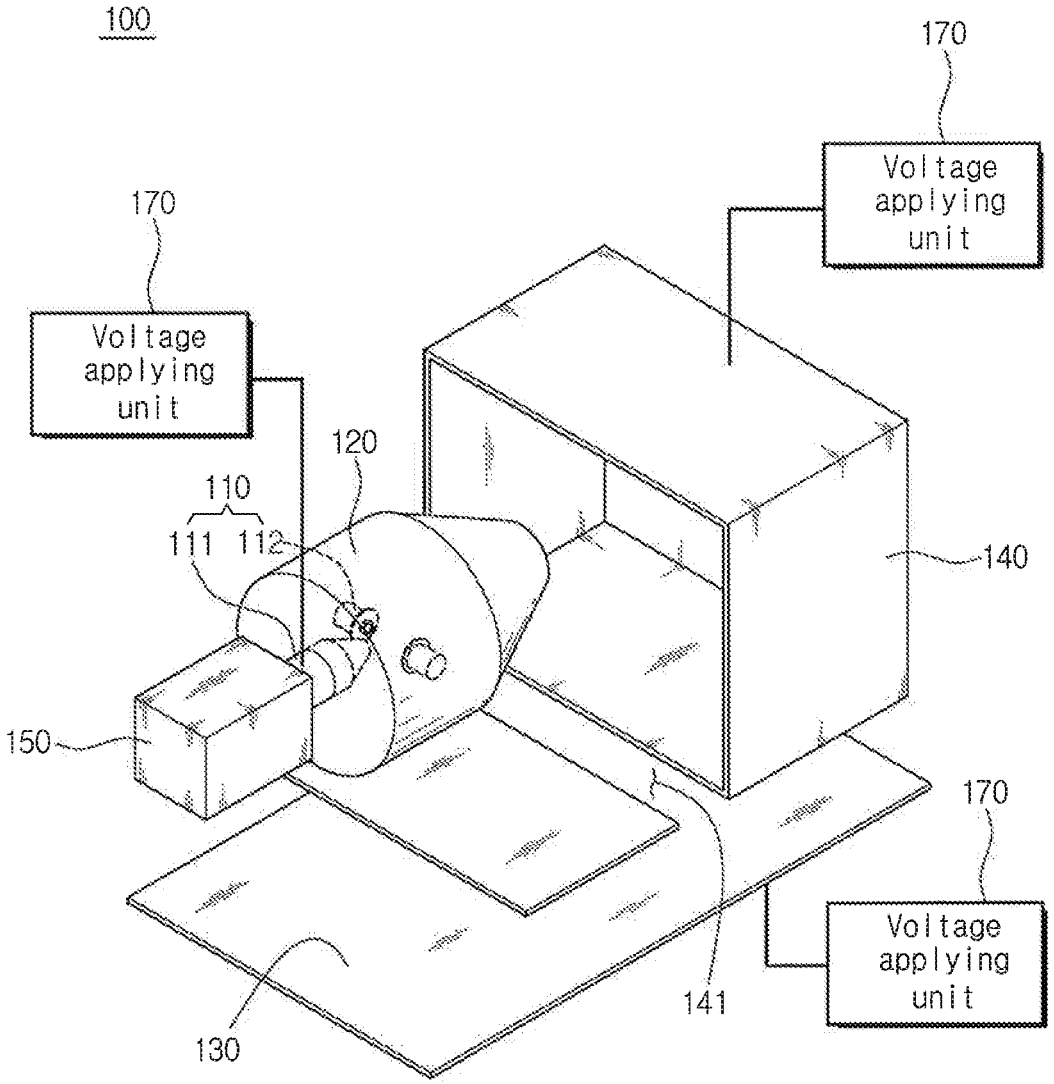
FIG. 1 is perspective diagram of an apparatus for spraying and patterning, using an electrostatic force, according to a first embodiment of the present disclosure.
Figure 2:
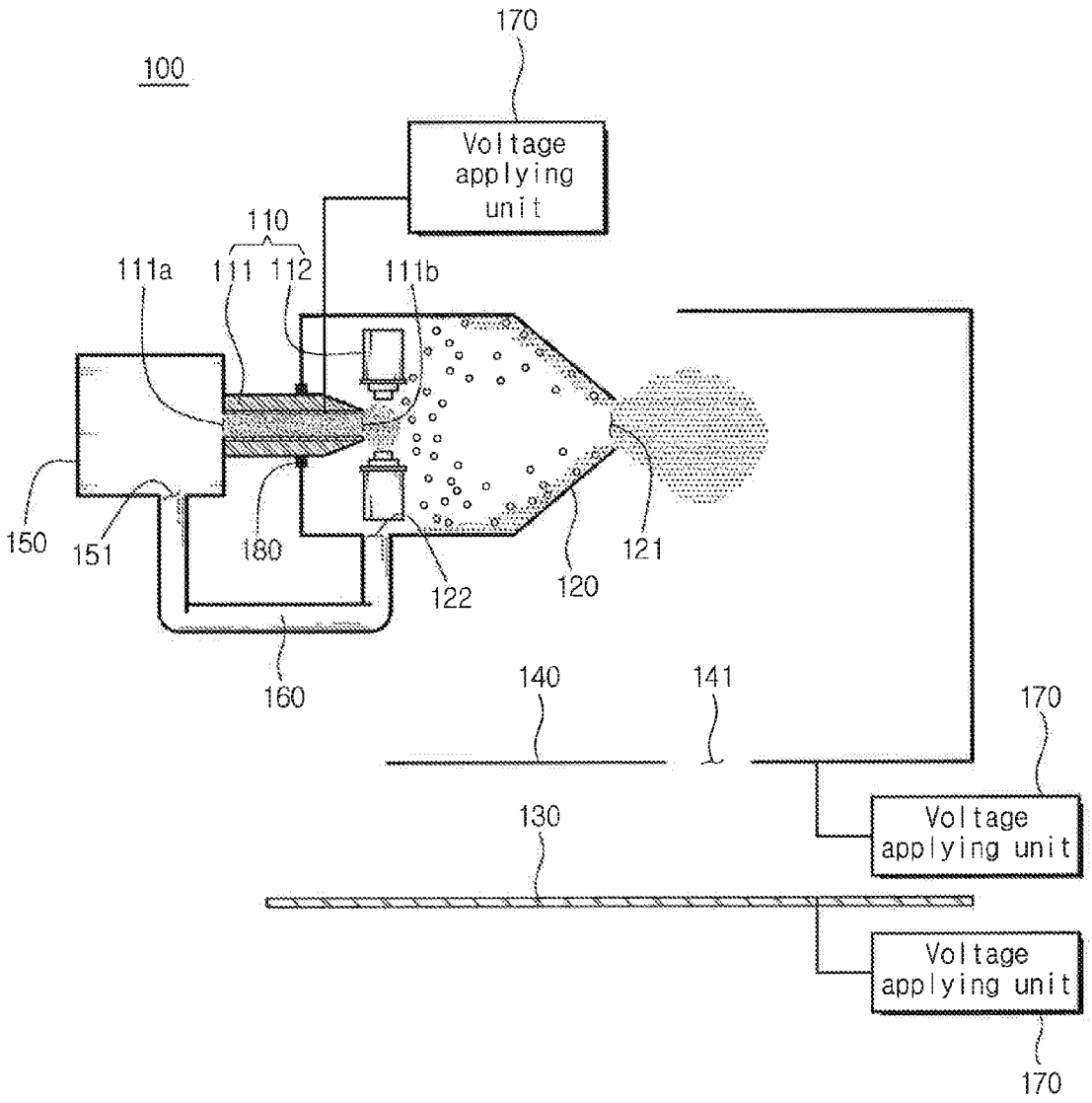
FIG. 2 is a schematic diagram of the apparatus for spraying and patterning, using the electrostatic force, shown in FIG. 1.

FIG. 1 is perspective diagram of an apparatus for spraying and patterning, using an electrostatic force, according to a first embodiment of the present disclosure. FIG. 2 is a schematic diagram of the apparatus for spraying and patterning, using the electrostatic force, shown in FIG. 1.

As shown in FIGS. 1 and 2, the apparatus for spraying and patterning, using the electrostatic force, according to the first embodiment of the present disclosure includes a nozzle 110, a droplet circulation chamber 120 connected to an end of the nozzle 110, a substrate 130 arranged in parallel to a longitudinal direction of the nozzle 110, a mask 140 provided between the nozzle 110 and the substrate 130, an ink supply unit 150 connected to the other end of the nozzle 110, a circulation pipe 160 for connecting the droplet circulation chamber 120 and the ink supply unit 150 with each other, a voltage applying unit 170 for applying a voltage to the nozzle 110, the substrate 130 and the mask 140, and a sealing material 180 disposed between the nozzle 110 and the droplet circulation chamber 120.

The nozzle 110 is affected by an electric field generated with the substrate 130 and it is configured to exhaust the ink supplied from the ink supply unit 150 toward the droplet circulation chamber 120 in a fine particle.

The nozzle 110 includes a liquid nozzle 111 and a gas nozzle 112. In this embodiment, a voltage is applied to the nozzle 110 by the voltage applying unit 170.

The liquid nozzle 111 sprays ink toward the droplet circulation chamber 120 as a passage where the ink is flowing.

The liquid nozzle 111 includes an inlet 111*a* and the outlet 111*b*. The inlet 111*a* is a region where ink is drawn from the ink supply unit 150 and the outlet 111*b* is a region where the ink is exhausted toward the droplet circulation chamber 120.

The inlet 111*a* and the outlet 111*b* are formed in both ends of the liquid nozzle 111, respectively. At this time, the end of the liquid nozzle 111 having the outlet 111*b* is held in the droplet circulation chamber 120, such that a disadvantage of droplet scattering caused by sudden dispersion of gas outside the nozzle can be overcome. That is to exhaust the ink held in the droplet circulation chamber 120 easily and to overcome the disadvantage of droplet scattering, and the embodiment is not limited to the installation mentioned above.

The gas nozzle is configured to spray gas and the gas sprayed from the gas nozzle 112 is collided with the ink on an outlet passage of the ink, only to atomize the ink primarily. When the gas collides with the ink, the gas nozzle 112 may spray the gas to collide with the ink, with making the outlet passage of the ink be perpendicular to the gas.

In other words, it is quite important to collide the gas with the ink for the primary atomization of the ink. Only when the gas is collided with the spray passage of the ink perpendicularly, the ink can be atomized stably.

Specifically, if the gas fails to collide with the spray passage of the liquid perpendicularly, the gas might affect a spray direction of the ink or the reverse direction of the spray direction. In case a force is applied along the spray direction of the ink by the collision, atomized droplets are exhausted at a too high speed. In case the force is applied along the reverse direction of the ink spraying by the collision, the spraying of the ink enabled by the gas is interfered with to have a negative effect on the amount of the sprayed ink and the spray speed of the ink.

The ink sprayed from the liquid nozzle 111 and primarily atomized by the gas is secondarily atomized by the electric field formed between the nozzle 110 and the substrate 130. The ink secondarily atomized by the electric field is sprayed in a nanometer~10 micrometer or less droplet type.

In brief, as mentioned above, the nozzle 110 primarily atomizes the sprayed ink through the collision with the gas and secondarily atomizes the primarily atomized ink having the electric field applied thereto, only to spray the liquid with a uniform size of micro droplets.

In this embodiment, the nozzle 110 has the liquid nozzle 111 and the gas nozzle 112 installed separately. The liquid nozzle 11 and the gas nozzle 112 are held in one case. When the ink is exhausted outside the case, the liquid nozzle 111 and the gas nozzle 112 may be provided differently based on the structure of the apparatus, for instance, completion of the primary atomization, which will be described later.

Meanwhile, the nozzle 10 may be arranged, with a longitudinal direction of the liquid nozzle 111 which is in parallel to the substrate 130, such that the disadvantage of pattern scattering caused by gas perturbation. Unless the pattering is scattered by the gas perturbation, the embodiment is not limited to such arrangement.

In this embodiment, the nozzle 110 is a pin type and other types of nozzles can be used in accordance with the characteristics of the ink or the structure of the apparatus. The embodiment is not limited thereto.

The droplet circulation chamber 120 may spray droplets of ink exhausted from the nozzle having a preset size enough to move along the electric field toward the substrate 130 and circulates the not-sprayed ink toward the ink supply unit 150.

The droplet circulation chamber 120 includes a hole 121 and a circulation hole 122. An empty space is formed in the droplet circulation chamber 120. The droplet circulation chamber 120 has a shape with a predetermined portion having a cross section gradually reduced toward the hole 121.

The nozzle is connected to the droplet circulation chamber 120. In this embodiment, the outlet 121*b* of the liquid nozzle 111 is held in the droplet circulation chamber 120. As mentioned above, the embodiment is not limited to such the installation. At this time, the droplet circulation chamber 120 is installed to cover the end of the nozzle 110 such that the disadvantage of the droplet scattering caused by the gas dispersed outside can be solved.

The hole 121 is the region for spraying the ink and it is affected by the electric field generated between the nozzle 110 and the substrate 130, only to spray the ink based on the size of the droplet particle. The hole 121 is formed in one end of the droplet circulation chamber 120.

The first circulation hole 122 is connected to a circulation pipe 160 and the ink not sprayed from the droplet circulation chamber 120 is exhausted outside. The first circulation hole 122 is formed in a lower surface of the droplet circulation chamber 120.

In other words, the droplet is secondarily atomized by the electric field while passing the droplet circulation chamber 120. During the process of spraying the droplet to the hole 121, relatively large sized droplets are temporarily stored in a lower surface of the droplet circulation chamber 120 by the gravity and the circulated flow of the gas exhausted from the nozzle 110.

Briefly, only droplets having a size of several micrometers or more are exhausted through the hole 121 droplets having a larger size are temporarily stored in the lower surface of the droplet circulation chamber 120. The temporarily stored droplets are re-circulated to the ink supply unit 150 through the circulation pipe 160.

The ink exhausted from the nozzle 110 is impacted and printed on the substrate 130. The substrate 130 is arranged in parallel to a longitudinal direction of the nozzle or the liquid nozzle 111.

To form the electric field between the nozzle mentioned above and the substrate 130, voltages are applied to them by the voltage applying unit 170. At this time, the voltage applied to the nozzle 110 is larger than the voltage applied to the substrate 130. It is not necessary to apply the voltage to the substrate and the substrate 130 may be electrically grounded to form the electric field with the nozzle 110.

The mask 140 is the material used in enhancing impact precision of the ink exhausted from the nozzle 110. The mask 140 focuses the electric field formed between the nozzle 110 and the substrate 130 toward a penetrated portion 141 to exhaust the ink.

The mask 140 is provided between the nozzle 110 and the substrate 130. A penetrated portion 141 is formed on the flow passage of the ink to make the ink exhausted from the nozzle 110 reach the substrate 120.

A plurality of penetrated portions 141 may be provided and multi-patterning is enabled by the plurality of the penetrated portions 141. At this time, the penetrated portions 141 are closed by a closing portion (not shown) to adjust the number of the penetrated portions 141 for spraying the droplets.

As a larger voltage than the voltage applied to the nozzle 110 is applied to the mask 140, the electric field is formed toward the nozzle 110 and the patterning is controlled not to be formed through the penetrated portions 141.

The penetrated portion may have a specific shape such that multi-patterning can be performed on a large area substrate 130 in a specific shape simultaneously.

Meanwhile, a voltage is applied to the mask 140 by the voltage applying unit 170 to focus the electric field on the penetrated portions 141. In case the plurality of the penetrated portions 141 are provided, the electric field is focused on the plurality of the penetrated portions 141. At this time, the voltage applied to the mask 140 is smaller than the voltage applied to the nozzle 110 and larger than the voltage applied to the substrate 130. Accordingly, the electric field from the nozzle 110 toward the penetrated portions 140 may be formed. It is not necessary to apply the voltage to the mask 140. In case an electric field focusing unit is installed, a voltage is applied to the electric field focusing unit and the mask 140 is provided as an insulative material. That embodiment will be described later.

Meanwhile, in case the voltage applied to the mask 140 is larger than the voltage applied to the nozzle, the electric field is formed toward the nozzle 110 by a repulsive force, which makes the electrospray difficult. Accordingly, it may be determined how to control the penetrated portions 141 through which the droplets pass and whether to operate the apparatus according to the present disclosure.

The ink supply unit 150 is configured to supply ink to the nozzle 110. The ink supply unit 150 is connected to the nozzle 110. An empty space is formed in the ink supply unit 150 to hold ink. A second circulation hole 151 is provided in one surface of the ink supply unit 150, with being connected to the circulation pipe 160 to draw the fine particle type of ink circulated from the droplet circulation chamber 120 into the ink supply unit 150.

The circulation pipe 160 is configured to circulate the pine particle types of the ink held in the droplet circulation chamber 120 to the ink supply unit 150. Only if the ink failed to be sprayed outside the droplet circulation chamber 120 is circulated to the ink supply unit, the method for forming the circulation pipe 160 is not limited.

The voltage applying unit 170 is a material for applying voltages to the nozzle, 110, the substrate 130 and the mask 140.

As mentioned above, the voltage applied to the mask 140 is smaller than the voltage applied to the nozzle 110 and voltage applied to the substrate 130. A voltage is not applied to the substrate 130 but grounded in the substrate 130, such that the voltages applied to the nozzle 110 and the substrate 130 can be set easily.

In this embodiment, the voltage applying unit 170 is additionally provided to apply voltages to the nozzle 110, the substrate 130 and the mask 140, respectively. However, the present disclosure is not limited thereto and the voltages may be applied through additional control performed by one voltage applying unit 170.

The sealing member 180 is the material for preventing the ink inside the droplet circulation chamber 120 from separating therefrom. The sealing member 180 is disposed between the nozzle 110 and the droplet circulation chamber 120.

The outlet 111*b* of the nozzle 110 is held in the droplet circulation chamber 120, so as to prevent the ink from separating from the droplet circulation chamber 120. However, as the sealing member 180 seals the droplet circulation chamber 120, the ink can be prevented from separating from the droplet circulation chamber 120 easily.

In this embodiment, an O-ring is used as the sealing member 180. The embodiment is not limited thereto and any materials only for preventing the ink from separating from the droplet circulation chamber 120 may be used as the sealing member 180 variable according to shapes or materials of the nozzle 110 and the droplet circulation chamber 120.

Hereinafter, an operation of the apparatus for spraying and patterning, using the electrostatic force according to the first embodiment of the present disclosure will be described.

Figure 3:
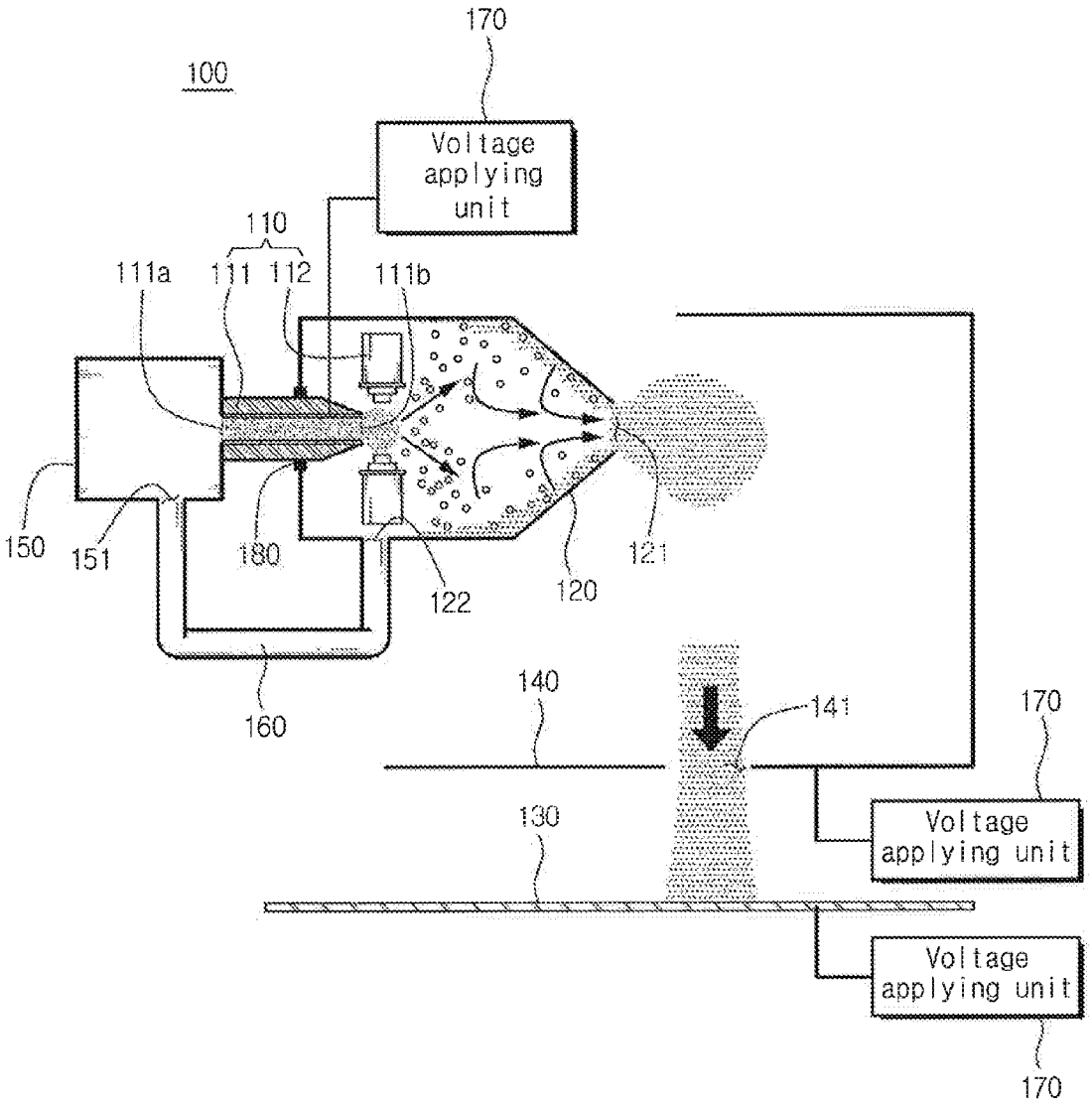
FIG. 3 is a diagram illustrating an operation of the apparatus for spraying and patterning, using the electrostatic force, shown in FIG. 1.
Figure 4:
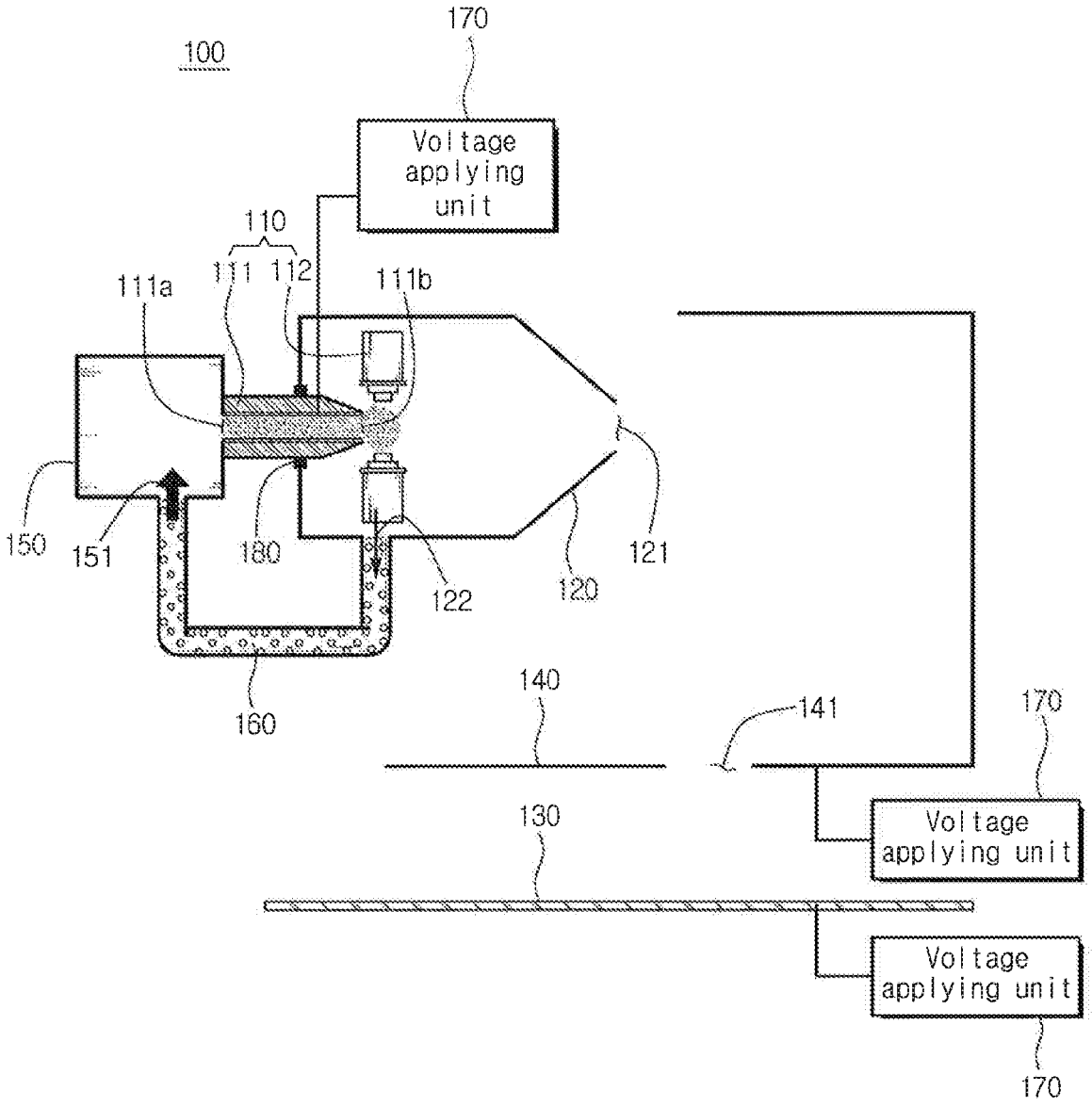
FIG. 4 is a diagram illustrating an operation of the apparatus for spraying and patterning, using the electrostatic force, shown in FIG. 1.

FIGS. 3 and 4 are diagrams illustrating the operation of the apparatus for spraying and patterning, using the electrostatic force according to the first embodiment of the present disclosure.

First of all, a region where ink is impacted is set on the substrate 130. After that, the penetrated portions 141 of the mask 140 are arranged to be positioned in the region where the ink is impacted.

Hence, the voltage applying unit 170 applies voltages to the nozzle 110, the substrate 130 and the mask 140. At this time, the voltage larger than the voltage applied to the mask 140 is applied to the nozzle 110. The voltage larger than the voltage applied to the substrate 130 is applied to the mask 140. At this time, the voltage applying unit may be electrically grounded to the substrate 130, not applying the voltage to the substrate 130.

When the voltages are applied to the nozzle 110 and the substrate 130 by the voltage applying unit 150, an electric field is formed toward the nozzle 110 to the substrate 130. As the voltage is applied to the mask 140, the electric field is focused toward the penetrated portions 141 of the mask 140. In other words, an electric field of the electric fields formed between the nozzle 110 and the substrate 130 is focused on the penetrated portions 141.

Meanwhile, the nozzle 110 supplied the ink from the ink supply unit 150 through the inlet 111*a* exhausts the ink by the electric field formed between the nozzle 110 and the substrate 130. An electric force of the electric field is larger than a surface tension of the ink positioned in the outlet 111*b*, only to exhaust the fine particle type of the ink from the outlet 111*b* into the droplet circulation chamber 120.

Referring to FIG. 3, the ink exhausted from the outlet 111*b* into the droplet circulation chamber 120 is primarily atomized by the gas sprayed from the gas nozzle 112. Then, the primarily atomized ink is secondarily atomized by the electric field formed between the nozzle 110 and the substrate 130. Accordingly, the ink is atomized into 10 micrometers or less of droplets.

While the ink is sprayed to the hole 121 of the droplet circulation chamber 120, large droplets are collected in a lower surface of the droplet circulation chamber 120 by the gravity and the circulation of the gas leaked from the nozzle 110.

In other words, only droplets with a size of several micrometers or less which can move along the electric field are sprayed to the hole 121. Droplets with a larger size are temporarily collected in the lower surface of the droplet circulation chamber 120. The temporarily collected droplets are re-circulated to the ink supply unit 150 through the circulation pipe 160.

At this time, the ink sprayed through the hole 121 by the electric field focused on the penetrated portions 141 is impacted to precise positions on the substrate 130, such that print precision can be enhanced and that contamination of the mask 140 can be prevented.

Moreover, the width of the penetrated portion 141 is adjusted only to impact the ink on the substrate 130 more precisely.

Referring to FIG. 4, the ink not sprayed from the droplet circulation chamber 120 is circulated to the ink supply unit 120 through the first circulation hole 121 and the second circulation hole 151, to pass the series of the processes again and to be sprayed in fine particle types.

At this time, the nozzle 110 and the mask 140 are moved integrally, such that patterning (e.g., a jet printer) can be enabled. In case the electric field focusing unit 790 is installed which will be described later, the nozzle 110 and the electric field focusing unit 790 are moved integrally and patterning such as a printer may be realized. Also, that may be realized by the integral moving of the substrate 130 and the electric field focusing unit 790.

Next, an apparatus for spraying and patterning, using an electrostatic force, according to a second embodiment of the present disclosure will be described.

Figure 5:
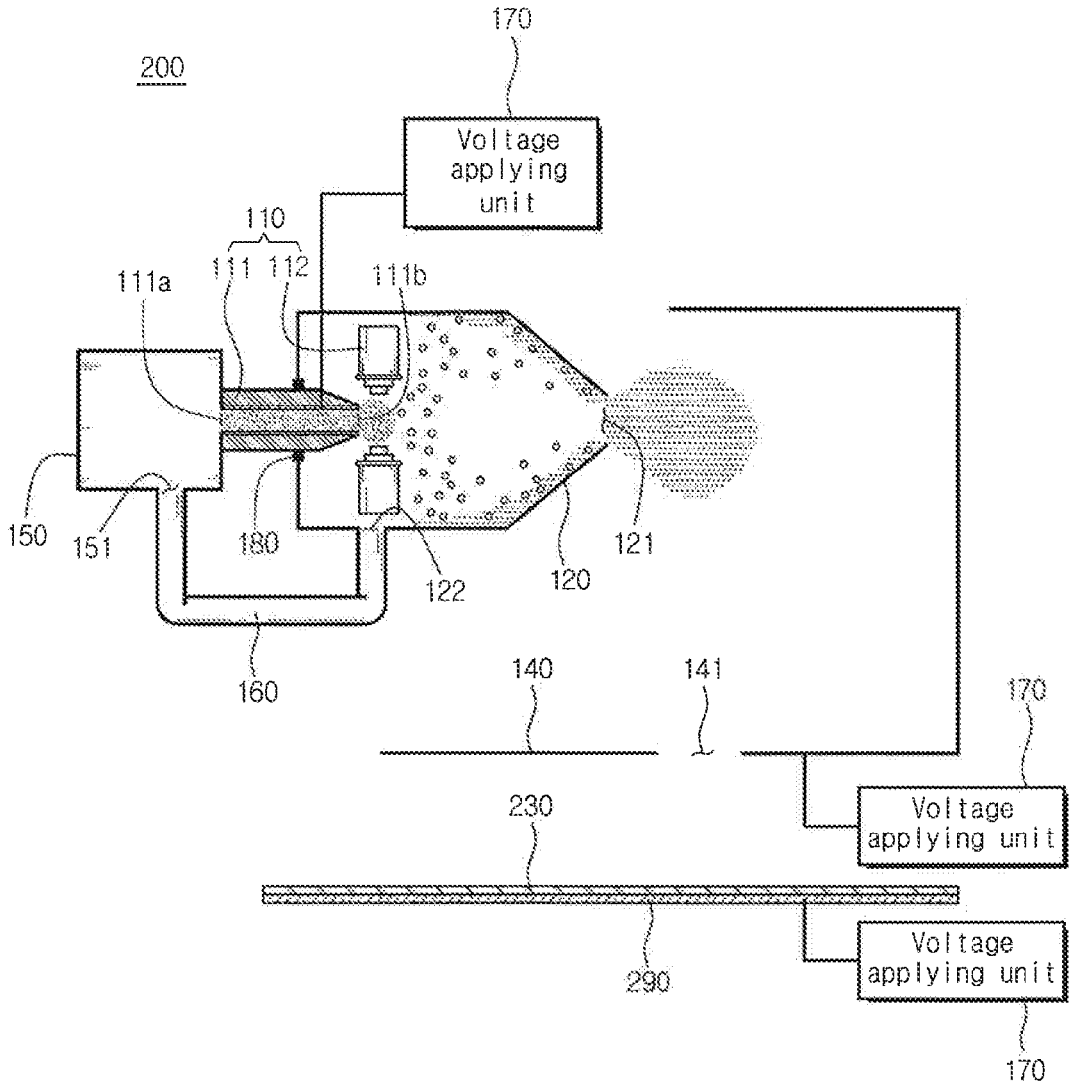
FIG. 5 is a schematic diagram of an apparatus for spraying and patterning, using an electrostatic force, according to a second embodiment of the present disclosure.

FIG. 5 is a schematic diagram of an apparatus for spraying and patterning, using an electrostatic force, according to a second embodiment of the present disclosure;

Referring to FIG. 5, the apparatus for spraying and patterning, using the electrostatic force, according to the second embodiment of the present disclosure (200, hereinafter, the spraying and patterning apparatus using the electrostatic force) includes a nozzle 110, a droplet circulation chamber 120 connected to an end of the nozzle 110, a substrate 130 installed in parallel to a longitudinal direction of the nozzle 110, a mask 140 provided between the nozzle 110 and the substrate 130, an ink supply unit 150 connected to the other end of the nozzle 110, a circulation pipe 160 for connecting the droplet circulation chamber 120 and the ink supply unit 150 with each other, a voltage applying unit 170 for applying voltages to the nozzle 110 and the mask 140, a sealing member 180 disposed between the nozzle 110 and the droplet circulation chamber 120, and a counter electrode 290 installed in the substrate 130.

The nozzle 110, the droplet circulation chamber 120, the mask 140, the ink supply unit 150, the circulation pipe 160, the voltage applying unit 170 and the sealing member 180 according to this embodiment are equal to the corresponding elements according to the first embodiment and detailed description of them will be omitted.

The substrate 230 is formed of an electrically insulated material, which is different from the substrate according to the first embodiment. In other words, the substrate 230 according to this embodiment is formed of a non-conductive material (e.g., film, ceramic and glass). The counter electrode 290 is provided in the substrate 230. Accordingly, in this embodiment, the voltage applying unit 170 may not apply an additional voltage to the substrate 230 which will be described later.

At this time, the counter electrode 290 is provided in a counter surface of a surface possessed by the substrate 230 where the ink is impacted. A voltage is applied to the counter electrode 290, instead of the substrate 230 having the electrically insulation property. In other words, in this embodiment, the substrate 230 has the electrically insulated property but the voltage is applied to the counter electrode 290 installed in the counter one of the surface where the ink is impacted, such that the electric field can be formed between the nozzle and the substrate 230.

Accordingly, in this embodiment different from the first embodiment, the ink may be impacted on the substrate 230 formed of the non-conductive material, using the electrostatic force.

Hereinafter, an apparatus for spraying and patterning, using an electrostatic force, according to a third embodiment will be described.

Figure 6:
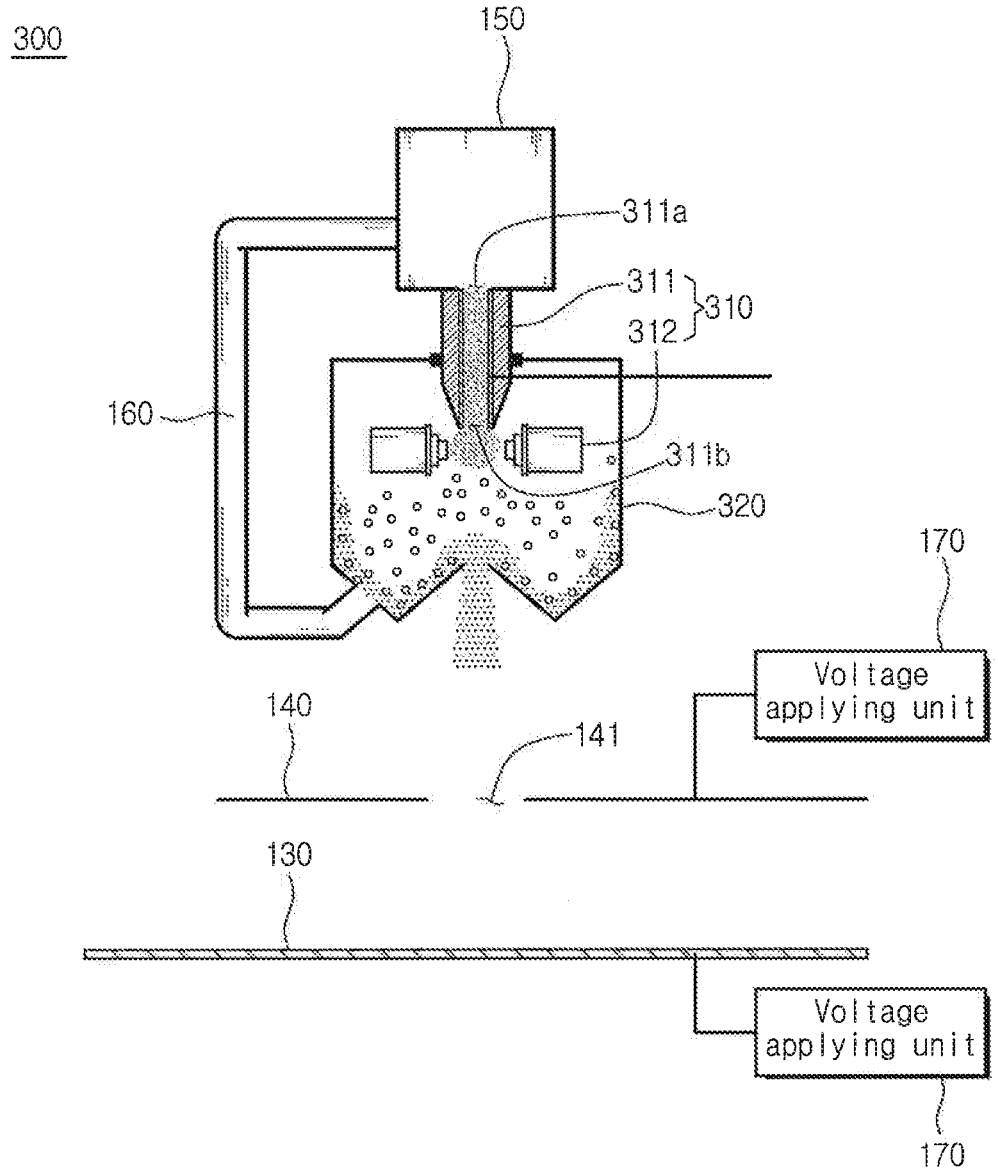
FIG. 6 is a schematic diagram of an apparatus for spraying and patterning, using an electrostatic force, according to a third embodiment of the present disclosure.

FIG. 6 is a schematic diagram of an apparatus for spraying and patterning, using an electrostatic force, according to a third embodiment of the present disclosure.

Referring to FIG. 6, the apparatus for spraying the apparatus for spraying and patterning, using the electrostatic force, according to the third embodiment of the present disclosure (300, hereinafter, the spraying and patterning apparatus using the electrostatic force) includes a nozzle 310, a droplet circulation chamber 320 connected to an end of the nozzle 310, a substrate 130 installed in vertical to a longitudinal direction of the nozzle 310, a mask 140 provided between the nozzle 310 and the substrate 130, an ink supply unit 150 connected to the other end of the nozzle 310, a circulation pipe 160 for connecting the droplet circulation chamber 320 and the ink supply unit 150 with each other, a voltage applying unit 170 for applying voltages to the nozzle 310 and the substrate 130 and the mask 140, and a sealing member 180 disposed between the nozzle 310 and the droplet circulation chamber 320.

The substrate 130, the mask 140, the ink supply unit 150, the circulation pipe 160, the voltage applying unit 170 and the sealing member 180 according to this embodiment are equal to the corresponding elements according to the second embodiment and detailed description of them will be omitted.

The nozzle 310 is the material is affected by the electric field formed between the substrate 130 and itself to exhaust the ink held therein after supplied from the ink supply unit 150 toward the droplet circulation chamber 320 in fine particle shapes.

The nozzle 310 includes a liquid nozzle 311 and a gas nozzle 312. In this embodiment, a voltage is applied to the nozzle 310 by the voltage applying unit 170.

The liquid nozzle 311 exhausts ink toward the droplet circulation chamber 320 as an ink flow passage. The liquid nozzle 311 includes an inlet 311*a* and an outlet 311*b*. The gas nozzle 312 sprays gas and the gas sprayed from the gas nozzle 312 is collided with the ink on an outlet passage of the ink, such that the ink can be primarily atomized. In other words, the nozzle 310 is employed to primarily atomize the ink by colliding the gas with the sprayed ink.

At this time, an end of the liquid nozzle 311 where the outlet 311*b* is provided is held in the droplet circulation chamber 320, such that the gas may be dispersed outside the nozzle 310 to solve the droplet scattering. That is to solve the disadvantage of the droplet scattering and the present disclosure is not limited to such the installation.

Meanwhile, a longitudinal direction of the liquid nozzle 311 provided in the nozzle 310 is arranged perpendicular to the substrate 130 which will be described later.

In this embodiment, the nozzle 310 is a pin type capable of exhausting ink in fine particles. The nozzle 310 may be other types according to properties of ink and a structure of an apparatus and the present disclosure is not limited thereto.

The droplet circulation chamber 320 is configured to spray fine particle ink out of the ink exhausted from the nozzle 310 toward the substrate 130 and to circulate the not-sprayed ink toward the ink supply unit 150.

An empty space is formed in the droplet circulation chamber 320 and the droplet circulation chamber 320 includes a hole and a first circulation hole. The nozzle 310 is connected to the droplet circulation chamber 320. Specifically, the nozzle 310 is partially held in the droplet circulation chamber 320 to hold the outlet 311*b* in the droplet circulation chamber 320.

At this time, the droplet circulation chamber 320 is provided to hold the end of the nozzle 310 and the disadvantage of the patterning scattered by the disturbance of the gas injected to the gas nozzle 312 can be solved.

The hole is the region for spraying the ink based on the particle size after affected by the electric field formed between the nozzle 310 and the substrate 130. In this embodiment, the hole is formed in a bottom of the droplet circulation chamber 320 to impact the ink sprayed in the fine particle types on the substrate 130 perpendicularly. At this time, the other region of the bottom of the droplet circulation chamber 320 is curbed from a lower direction to an upper direction to temporarily collect the not sprayed ink. The first circulation hole is formed in the space where the ink is temporarily collected and the fine particle ink may be circulated to the ink supply unit 150.

Specifically, in this embodiment different from the first or second embodiment, the nozzle 310 is arranged perpendicular to the substrate 130 and the fine particle types of the ink may be circulated to the ink supply unit 150 from the droplet circulation chamber 320 having the curved portion from the lower direction to the upper direction.

Hereinafter, an apparatus for spraying and patterning, using an electrostatic force, according to a fourth embodiment will be described.

Figure 7:
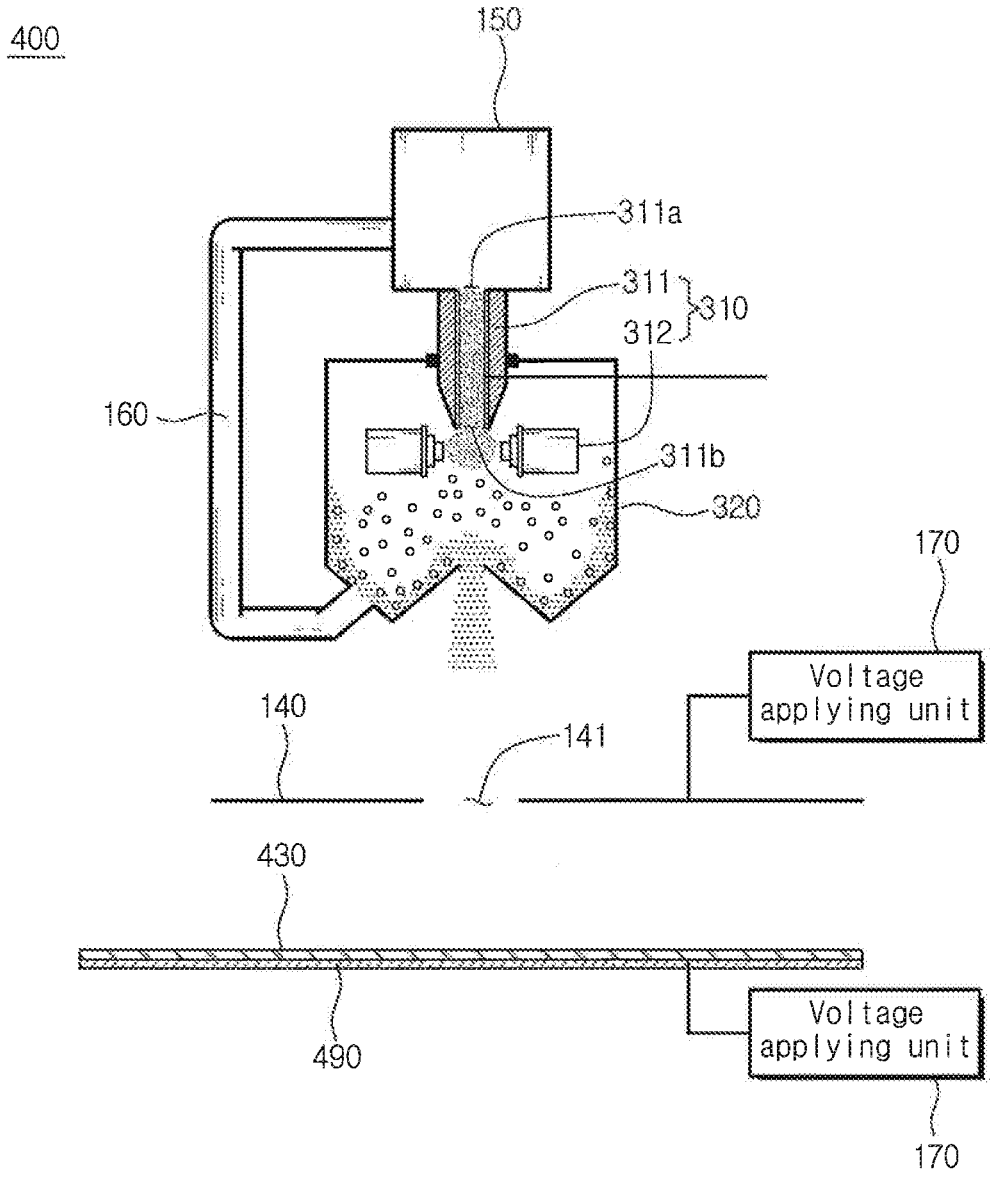
FIG. 7 is a schematic diagram of an apparatus for spraying and patterning, using an electrostatic force, according to a fourth embodiment of the present disclosure.

FIG. 7 is a schematic diagram of an apparatus for spraying and patterning, using an electrostatic force, according to a fourth embodiment of the present disclosure.

Referring to FIG. 7, the apparatus for spraying the apparatus for spraying and patterning, using the electrostatic force, according to the fourth embodiment of the present disclosure (400, hereinafter, the spraying and patterning apparatus using the electrostatic force) includes a nozzle 310, a droplet circulation chamber 320 connected to an end of the nozzle 310, a substrate 430 installed in vertical to a longitudinal direction of the nozzle 310, a mask 140 provided between the nozzle 310 and the substrate 430, an ink supply unit 150 connected to the other end of the nozzle 310, a circulation pipe 160 for connecting the droplet circulation chamber 320 and the ink supply unit 150 with each other, a voltage applying unit 170 for applying voltages to the nozzle 310 and the mask 140, a sealing member 180 disposed between the nozzle 310 and the droplet circulation chamber 320, and a counter electrode 490 installed in the substrate 430.

The nozzle 310, the droplet circulation chamber 320, the mask 140, the ink supply unit 150, the circulation pipe 160, the voltage applying unit 170 and the sealing member 180 according to this embodiment are equal to the corresponding elements according to the third embodiment and detailed description of them will be omitted.

The substrate 430 is formed of an electrically insulated material, which is different from the substrate according to the first embodiment. In other words, the substrate 430 according to this embodiment is formed of a non-conductive material (e.g., film, ceramic and glass). The counter electrode 490 is provided in the substrate 430. Accordingly, in this embodiment, the voltage applying unit 170 may not apply an additional voltage to the substrate 430 which will be described later.

At this time, the counter electrode 490 is provided in a counter surface of a surface possessed by the substrate 430 where the ink is impacted. A voltage is applied to the counter electrode 490, instead of the substrate 430 having the electrically insulation property. In other words, in this embodiment, the substrate 430 has the electrically insulated property but the voltage is applied to the counter electrode 490 installed in the counter one of the surface where the ink is impacted, such that the electric field can be formed between the nozzle and the substrate 430.

Accordingly, in this embodiment different from the first embodiment, the ink may be impacted on the substrate 430 formed of the non-conductive material, using the electrostatic force.

Hereinafter, an apparatus for spraying and patterning, using an electrostatic force, according to a fifth embodiment will be described.

Figure 8:
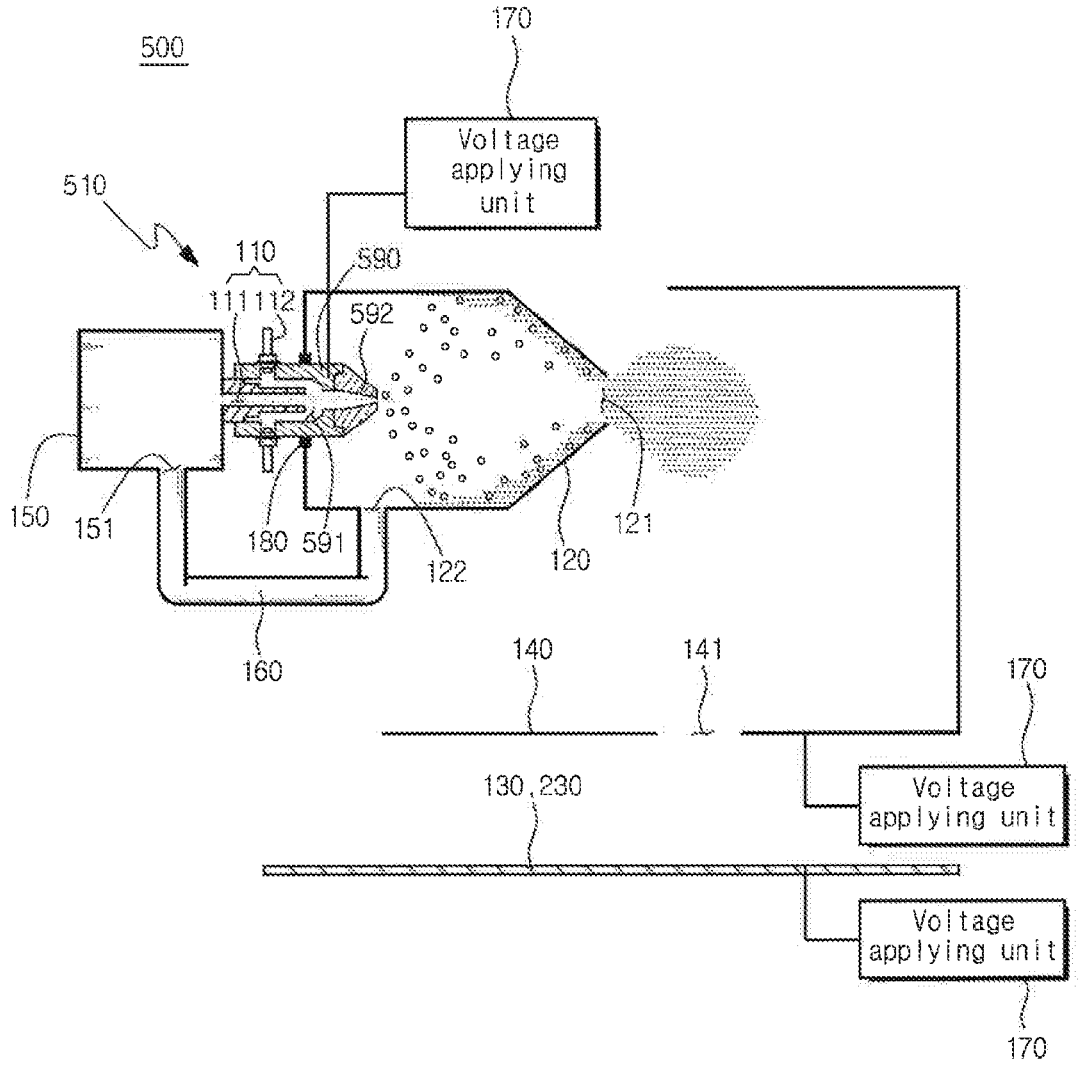
FIG. 8 is a schematic diagram of an apparatus for spraying and patterning, using an electrostatic force, according to a fifth embodiment of the present disclosure.

FIG. 8 is a schematic diagram of an apparatus for spraying and patterning, using an electrostatic force, according to a fifth embodiment of the present disclosure.

Referring to FIG. 8, the apparatus for spraying the apparatus for spraying and patterning, using the electrostatic force, according to the fifth embodiment of the present disclosure (500, hereinafter, the spraying and patterning apparatus using the electrostatic force) includes a nozzle 510, a droplet circulation chamber 120 connected to an end of the nozzle 510, substrates 130 and 230 installed in parallel to a longitudinal direction of the nozzle 510, a mask 140 provided between the nozzle 510 and the substrates 130 and 230, an ink supply unit 150 connected to the other end of the nozzle 510, a circulation pipe 160 for connecting the droplet circulation chamber 120 and the ink supply unit 150 with each other, a voltage applying unit 170 for applying voltages to the nozzle 510 and the mask 140, a sealing member 180 disposed between the nozzle 510 and the droplet circulation chamber 120, and a case 590 for holding a liquid nozzle 111 and a gas nozzle 112.

The nozzle 510, the droplet circulation chamber 120, the mask 140, the ink supply unit 150, the circulation pipe 160, the voltage applying unit 170 and the sealing member 180 according to this embodiment are equal to the corresponding elements according to the first embodiment and detailed description of them will be omitted.

The case 590 holds the liquid nozzle 111 and the gas nozzle 112.

The collision between the ink and the ink occurs in the case 590. In other words, when the ink is exhausted outside the case 590, the primary atomization of the ink is already completed and the secondary atomization is generated outside the case 590 by the electric field, which is different from the nozzle 110 and 310 mentioned above.

At this time, the longitudinal direction of the nozzle 510 is arranged in parallel to the substrates 130 and 230 to solve the disadvantage of the patterning scattered by gas disturbance.

Meanwhile, the gas sprayed from the gas nozzle 112 flows in the case 590. A gas passage 591 is formed in the case to guide the gas to collide with the ink, with forming a passage perpendicular to an outlet passage of the ink. A guide portion 592 may be formed in the case 590 to spray the liquid toward the substrates 130 and 230 and the present disclosure is not limited thereto.

In this embodiment, the substrate 130 or 230 is the material where the ink exhausted from the nozzle 510 is impacted and printed. The substrate 130 and 230 may be formed of the electrically conductive material like the first embodiment and a voltage is applied to the substrates 130 and 230, to form the electric field between the nozzle 510 and the substrates. Like the second embodiment, the substrate is formed of the material having the electrically insulative material and the voltage may be applied to the counter electrode 290, to form the electric field between the nozzle 110 and the substrate.

Accordingly, in this embodiment different from the first embodiment or the second embodiment, the gas nozzle 112 is provided on the outlet passage of the ink to spray gas and the ink is collided with the gas in the case 590, such that more elaborate patterning can be performed.

Hereinafter, an apparatus for spraying and patterning, using an electrostatic force, according to a sixth embodiment will be described.

Figure 9:
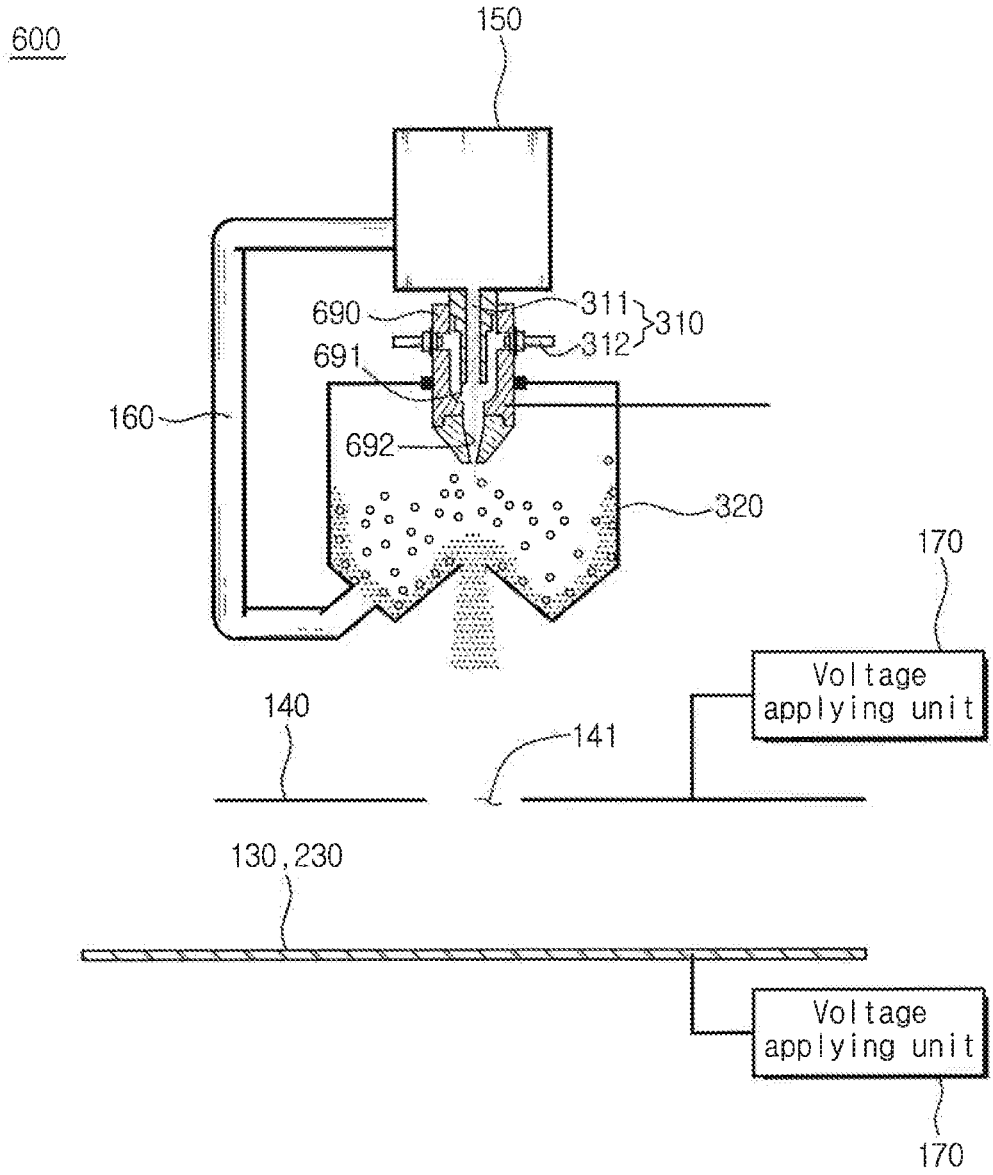
FIG. 9 is a schematic diagram of an apparatus for spraying and patterning, using an electrostatic force, according to a sixth embodiment of the present disclosure.

FIG. 9 is a schematic diagram of an apparatus for spraying and patterning, using an electrostatic force, according to a six embodiment of the present disclosure.

Referring to FIG. 9, the apparatus for spraying the apparatus for spraying and patterning, using the electrostatic force, according to the sixth embodiment of the present disclosure (600, hereinafter, the spraying and patterning apparatus using the electrostatic force) includes a nozzle 310, a droplet circulation chamber 320 connected to an end of the nozzle 310, substrates 130 and 230 installed in vertical to a longitudinal direction of the nozzle 310, a mask 140 provided between the nozzle 310 and the substrates 130 and 230, an ink supply unit 150 connected to the other end of the nozzle 310, a circulation pipe 160 for connecting the droplet circulation chamber 320 and the ink supply unit 150 with each other, a voltage applying unit 170 for applying voltages to the nozzle 310 and the mask 140, a sealing member 180 disposed between the nozzle 310 and the droplet circulation chamber 320, and a case 690 for holding a liquid nozzle 311 and a gas nozzle 312.

The case 690 holds the liquid nozzle 311 and the gas nozzle 312.

The collision between the ink and the ink occurs in the case 690. In other words, when the ink is exhausted outside the case 690, the primary atomization of the ink is already completed and the secondary atomization is generated outside the case 690 by the electric field, which is different from the nozzle 110 and 310 mentioned above.

A gas passage 691 may be formed in the case 690 to flow the gas sprayed from the gas nozzle 312 therein and to guide the gas to collide the ink, with be perpendicular to the outlet passage of the ink. A guide portion 692 may be formed in the case 690 to guide the liquid sprayed toward the substrates 130 and 230 and the present disclosure is not limited thereto.

In this embodiment different from the third embodiment or the fourth embodiment, the gas nozzle 312 may be provided on the outlet passage of the ink to guide the spraying of the gas and the ink is collided with the gas in the case 690, such that more elaborate patterning can be performed.

Hereinafter, an apparatus for spraying and patterning, using an electrostatic force, according to a seventh embodiment will be described.

Figure 10:
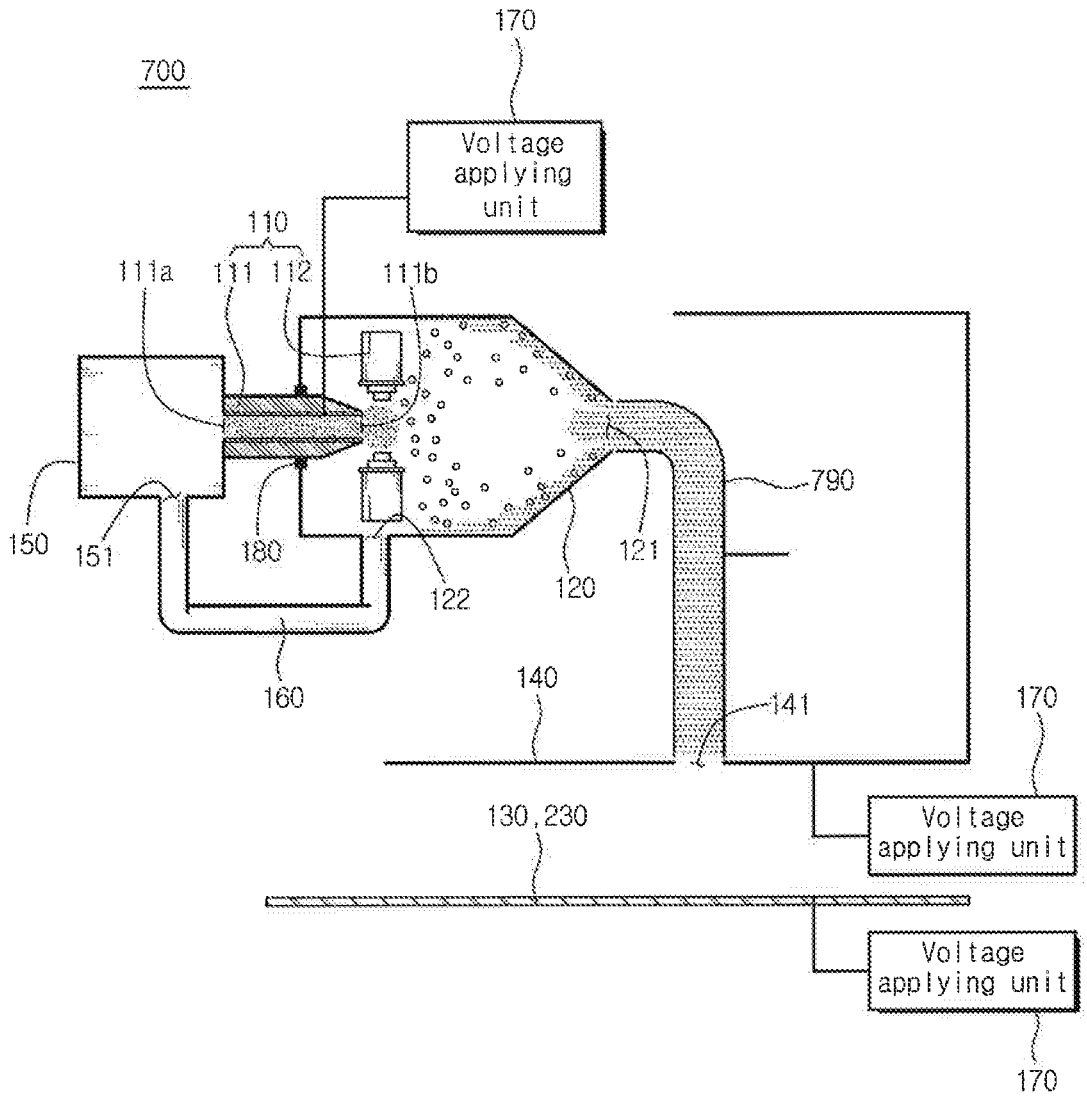
FIG. 10 is a schematic diagram of an apparatus for spraying and patterning, using an electrostatic force, according to a seventh embodiment of the present disclosure.
Figure 11:
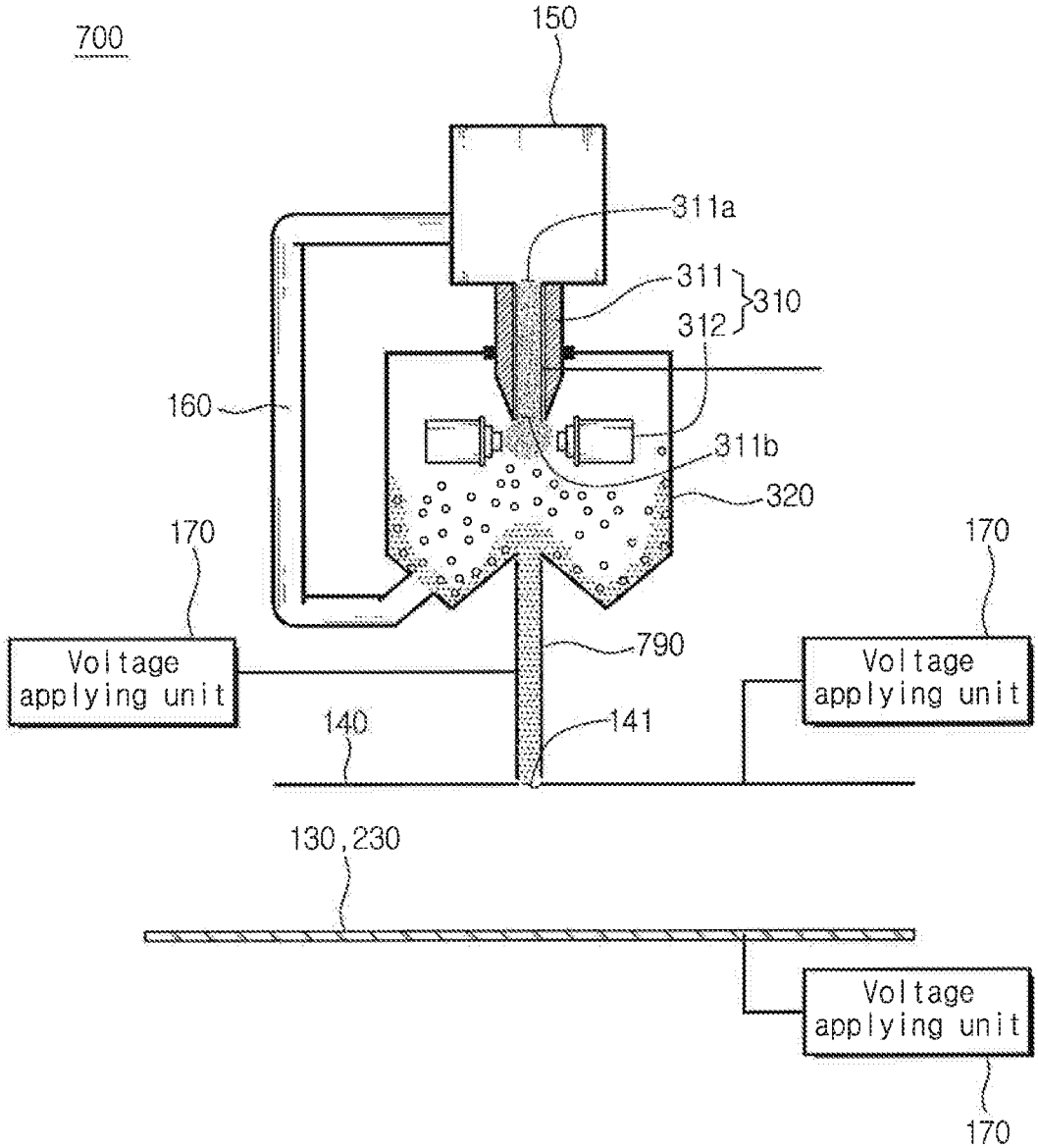
FIG. 11 is a schematic diagram of an apparatus for spraying and patterning, using an electrostatic force, according to a seventh embodiment of the present disclosure.

FIGS. 10 and 11 are schematic diagrams of an apparatus for spraying and patterning, using an electrostatic force, according to a seventh embodiment of the present disclosure.

Referring to FIG. 10 or 11, the apparatus for spraying the apparatus for spraying and patterning, using the electrostatic force, according to the seventh embodiment of the present disclosure (700, hereinafter, the spraying and patterning apparatus using the electrostatic force) includes a nozzle 110 and 310, a droplet circulation chamber 120 and 320 connected to an end of the nozzle 110 and 310, a substrate 130 and 230 installed spaced apart a predetermined distance from the nozzle 110 and 310, a mask 140 provided between the nozzle 110 and 310 and the substrates 130 and 230, an ink supply unit 150 connected to the other end of the nozzle 110 and 310, a circulation pipe 160 for connecting the droplet circulation chamber 120 and 320 and the ink supply unit 150 with each other, a voltage applying unit 170 for applying voltages to the nozzle 110 and 310 and the mask 140, a sealing member 180 disposed between the nozzle 310 and the droplet circulation chamber 320, and an electric field focusing unit 790 installed between the droplet circulation chamber 120 and 320 and the mask 140.

The nozzle 110 and 310, the droplet circulation chamber 120 and 320, the mask 140, the ink supply unit 150, the circulation pipe 160, the voltage applying unit 170 and the sealing member 180 according to this embodiment are equal to the corresponding elements according to the first or third embodiment and detailed description of them will be omitted.

The electric field focusing unit 790 is configured to focus the electric field formed between the droplet circulation chamber 120 and 320 and the mask 140. The electric field focusing unit 790 connects the droplet circulation chamber 120 and 320 having a hole 121 formed therein with the mask 140 having a penetration hole 141 formed therein. In other words, the electric field may be focused from the hole 121 to the mask 140 by the electric field focusing unit 790 sequentially. It is not necessary to connect the droplet circulation chamber 120 and 320 with the mask 140 and the electric field focusing unit 790 may be connected to one of them.

If the electric field focusing unit 790 is not provided, the electric field is formed between the droplet circulation chamber 120 and 320 and the substrate 130 and 230. At this time, the mask 140 is provided so as to allow more elaborate impacting and patterning performed on the substrate 130 and 230. A voltage is applied to the mask 140 and the electric field can be focused on the penetrated portions 141.

In this embodiment, the electric field focusing unit 790 is installed and the electric field is focused from the hole 121 to the substrate 130 and 230, such that more elaborate impacting and patterning of droplets can be performed.

A voltage is applied to the electric field focusing unit 790. At this time, the voltage applied to the electric field focusing unit 790 is larger than the voltages applied to the substrate 130 and 230 and the mask 140, and smaller than the voltage applied to the nozzle 110 and 310. Accordingly, the ink may be sprayed into the electric field focusing unit 790 through the hole 121 and induced toward the substrate 130 and 230.

Meanwhile, as mentioned above in the first embodiment, it is possible not to apply the voltage to the mask 140 in case the electric field focusing unit is installed. The mask 140 may be formed of an insulator or coated with an insulator.

Meanwhile, the electric field focusing unit 790 may integrally move with the nozzle 110 or 310 or the substrate 130 or 230, to realize patterning such as a printer.

The sealing member is provided between the electric field focusing unit 790 and the droplet circulation chamber 120 and 320, to focus the electric field more smoothly.

In other words, this embodiment may perform more elaborate impacting and patterning of the droplets, using the electric field focusing unit 790.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for spraying and patterning, using an electrostatic force, comprising:

a nozzle to which a voltage is applied to exhaust ink;

a droplet circulation chamber connected to one end of the nozzle, with a hole provided in one end to spray the ink exhausted from the nozzle based on a particle size of the droplet and to temporarily collect the not-sprayed ink; and a substrate for impacting the ink sprayed from the hole thereon by forming an electric field between the nozzle and the substrate;

a mask arranged between the droplet circulation chamber and the substrate, with a penetrated portion for adjusting a region where the ink is impacted, the mask to which a voltage is applied to focus an electric field in the penetrated portion;

an ink supply unit for holding the ink, the ink supply unit being connected to the nozzle to supply the ink; and a circulation pipe having one end connected to the droplet circulation chamber and the other end connected to the ink supply unit, to circulate the ink held in the droplet circulation chamber to the ink supply unit, wherein a voltage smaller than a voltage applied to the nozzle and larger than a voltage applied to the substrate is applied to the mask to spray the ink to the penetrated portion.

2. The apparatus for spraying and patterning, using the electrostatic force, of claim 1, further comprising:

an electric field focusing unit having one end connected to the hole and the other end connected to the mask, the electric field focusing unit to which a voltage is applied to focus the electric field in the penetrated portion.

3. The apparatus for spraying and patterning, using the electrostatic force of claim 1, wherein the nozzle comprises, a liquid nozzle for exhausting the ink;

a gas nozzle for primarily atomizing the ink by colliding the gas with the ink on an outlet passage of the ink; and a voltage applying unit connected to the liquid nozzle to generate an electric field between the liquid nozzle and the substrate so as to secondarily atomize the liquid.

4. The apparatus for spraying and patterning, using the electrostatic force, of claim 3, further comprising:

a case for holding the liquid nozzle and the gas nozzle therein, with a gas passage to guide the gas sprayed from the gas nozzle to collide with the liquid on the outlet passage of the liquid, wherein the gas is collided with the liquid in the case.

5. The apparatus for spraying and patterning, using the electrostatic force, of claim 1, further comprising:

a counter electrode provided in a counter surface of a surface where the ink is impacted, having a voltage applied thereto, wherein the substrate is formed of an electric insulative material.

6. The apparatus for spraying and patterning, using the electrostatic force of claim 1, wherein the nozzle is arranged for a longitudinal direction of the liquid nozzle to be in parallel to the substrate, and the hole is formed in an end portion of the droplet circulation chamber, with a predetermined portion of which a cross section area is reduced gradually toward the hole.

7. The apparatus for spraying and patterning, using the electrostatic force of claim 1, wherein the nozzle is arranged for a longitudinal direction of the liquid nozzle to be perpendicular to the substrate, and the hole is formed in a lower end portion of the droplet circulation chamber and the lower end portion is curved from a lower direction to an upper direction to form a space where the not sprayed ink is temporarily collected.

8. The apparatus for spraying and patterning, using the electrostatic force of claim 1, further comprising:

a sealing member for sealing the nozzle and the droplet circulation chamber to prevent the ink from leaking from the droplet circulation chamber.

* * * * *